US012767892B2

(12) United States Patent
Pasanen et al.

(10) Patent No.: US 12,767,892 B2
(45) Date of Patent: Oct. 20, 2026

(54) METHOD FOR UPGRADING LIQUEFIED WASTE PLASTICS

(71) Applicant: Neste Oyj, Espoo (FI)

(72) Inventors: Jukka-Pekka Pasanen, Porvoo (FI); Ville Paasikallio, Porvoo (FI); Risto Vapola, Porvoo (FI); Antti Ojala, Porvoo (FI)

(73) Assignee: Neste Oyj, Espoo (FI)

( * ) Notice: Subject to any disclaimer, the term of this patent is extended or adjusted under 35 U.S.C. 154(b) by 7 days.

(21) Appl. No.: 17/780,703

(22) PCT Filed: Nov. 27, 2020

(86) PCT No.: PCT/EP2020/083583

§ 371 (c)(1),
(2) Date: May 27, 2022

(87) PCT Pub. No.: WO2021/105327

PCT Pub. Date: Jun. 3, 2021

(65) Prior Publication Data

US 2023/0357643 A1 Nov. 9, 2023

(30) Foreign Application Priority Data

Nov. 29, 2019 (FI) ..... 20196035

(51) Int. Cl.
*C10G 1/00* (2006.01)
*C10G 1/10* (2006.01)
(Continued)

(52) U.S. Cl.
CPC ..... *C10G 1/002* (2013.01); *C10G 1/10* (2013.01); *C10G 3/40* (2013.01); *C10G 9/00* (2013.01);
(Continued)

(58) Field of Classification Search
None
See application file for complete search history.

(56) References Cited

U.S. PATENT DOCUMENTS 5,364,995 A 11/1994 Kirkwood et al.
5,731,483 A 3/1998 Stabel et al.
(Continued)

FOREIGN PATENT DOCUMENTS

CN 109563413 A 4/2019
CN 109844070 A 6/2019
(Continued)

OTHER PUBLICATIONS

Qatar Energy "Naphthas" pp. 1-3. Retrieved Mar. 8, 2024 (Year: 2024).*
(Continued)

*Primary Examiner* — Renee Robinson
*Assistant Examiner* — Alyssa L Cepluch
(74) *Attorney, Agent, or Firm* — Buchanan Ingersoll & Rooney PC

(57) ABSTRACT

The present disclosure relates to a method for upgrading liquefied waste plastics, the method including a step (A) of providing liquefied waste plastics (LWP) material, optionally a step (B) of pre-treating at least part of the liquefied waste plastics (LWP) material to produce a pre-treated liquefied waste plastics (LWP) material, a step (C) of blending the liquefied waste plastics (LWP) material and/or the pre-treated liquefied waste plastics (LWP) material with a highly paraffinic material to obtain a cracker feed such that the cracker feed meets the requirements for chlorine content and olefins content of the steam cracker, and a step (D) of steam cracking the cracker feed in a steam cracker to obtain a cracker product.

19 Claims, 2 Drawing Sheets

(51) Int. Cl.
*C10G 3/00* (2006.01)
*C10G 9/00* (2006.01)
*C10B 53/07* (2006.01)

(52) U.S. Cl.
CPC ..... *C10B 53/07* (2013.01); *C10G 2300/1003* (2013.01); *C10G 2300/202* (2013.01)

(56) References Cited

U.S. PATENT DOCUMENTS

| | | | | |
|---|---|---|---|---|
| 8,581,013 | B2 | 11/2013 | Abhari et al. | |
| 10,927,315 | B2 | 2/2021 | Ramamurthy et al. | |
| 11,139,583 | B2 | 10/2021 | Hu et al. | |
| 11,427,782 | B2 | 8/2022 | Toukoniitty et al. | |
| 2011/0289826 | A1 | 12/2011 | Srinakruang | |
| 2013/0184505 | A1* | 7/2013 | Maxwell | C10G 11/00 585/324 |
| 2016/0264874 | A1 | 9/2016 | Narayanaswamy et al. | |
| 2016/0264883 | A1* | 9/2016 | Narayanaswamy | C10G 1/10 |
| 2019/0002664 | A1 | 1/2019 | Streiff et al. | |
| 2019/0085147 | A1 | 3/2019 | Streiff et al. | |
| 2019/0148836 | A1 | 5/2019 | Hu et al. | |
| 2019/0177626 | A1 | 6/2019 | Ramamurthy et al. | |
| 2019/0233744 | A1 | 8/2019 | Narayanaswamy et al. | |
| 2019/0299491 | A1 | 10/2019 | Stanislaus et al. | |
| 2021/0189256 | A1 | 6/2021 | Rämöet al. | |
| 2021/0277324 | A1 | 9/2021 | Toukoniitty et al. | |

FOREIGN PATENT DOCUMENTS

| | | | | |
|---|---|---|---|---|
| EP | 0502618 | A1 | 9/1992 | |
| EP | 0567292 | A1 | 10/1993 | |
| EP | 0687692 | A1 | 12/1995 | |
| FI | 128069 | B | 9/2019 | |
| FI | 20185652 | A1 | 9/2019 | |
| JP | 2003034794 | A | 2/2003 | |
| JP | 2019527271 | A | 9/2019 | |
| JP | 2021530596 | A | 11/2021 | |
| WO | 2007126120 | A1 | 11/2007 | |
| WO | 2016058953 | A1 | 4/2016 | |
| WO | 2016142808 | A1 | 9/2016 | |
| WO | 2016142809 | A1 | 9/2016 | |
| WO | 2018010443 | A1 | 1/2018 | |
| WO | WO-2018011642 | A1 * | 1/2018 | C10G 1/002 |
| WO | WO-2018025103 | A1 * | 2/2018 | B29B 17/04 |
| WO | WO-2018025104 | A1 * | 2/2018 | B01J 29/084 |
| WO | 2018104443 | A1 | 6/2018 | |
| WO | 2019197721 | A1 | 10/2019 | |
| WO | 2020152320 | A1 | 7/2020 | |
| WO | 2020242912 | A1 | 12/2020 | |
| WO | 2020242916 | A1 | 12/2020 | |
| WO | 2020242917 | A1 | 12/2020 | |
| WO | 2020242925 | A1 | 12/2020 | |

OTHER PUBLICATIONS

Specification for Naphtha (Petrochemical Grade). https://www.mrpl.co.in/sites/default/files/%E0%A4%A8%E0%A5%88%E0%A4%Ab%E0%A5%8D%E0%A4%A4%E0%A4%BE/Naptha_petgrade_1437475712.pdf Retrieved Mar. 8, 2024 (Year: 2024).*

Notice of Acceptance for Patent Application issued on May 4, 2023, by the Australian Patent Office in corresponding Australian Patent Application No. 2020392420. (3 pages).

Office Action (Examination Report No. 2) issued on Mar. 28, 2023, by the Australian Patent Office in corresponding Australian Patent Application No. 2020392420. (3 pages).

Office Action issued on Dec. 12, 2023, by the Japanese Patent Office in corresponding Japanese Patent Application No. 2022-531636, and a machine English Translation of the Office Action. (5 pages).

Office Action (Notice of Reasons for Refusal) issued on Aug. 1, 2023, by the Japanese Patent Office in corresponding Japanese Patent Application No. 2022-531636, and an English Translation of the Office Action. (12 pages).

Office Action issued on Feb. 24, 2023, by the Canadian Patent Office in corresponding Canadian Patent Application No. 3,162,422. (6 pages).

International Search Report (PCT/ISA/210) and Written Opinion (PCT/ISA/237) mailed on Feb. 15, 2021, by the European Patent Office as the International Searching Authority for International Application No. PCT/EP2020/083583. (9 pages).

Office Action and Search Report dated Mar. 23, 2020 issued by the Finnish Patent and Registration Office in corresponding Finnish U.S. Appl. No. 20/196,035. (7 pages).

Office Action and Search Report dated May 9, 2022 issued by the Finnish Patent and Registration Office in corresponding Finnish U.S. Appl. No. 20/196,035. (7 pages).

Office Action and Search Report dated Sep. 9, 2020 issued by the Finnish Patent and Registration Office in corresponding Finnish U.S. Appl. No. 20/196,035. (6 pages).

Office Action (Examination report No. 1 for standard patent application) issued Feb. 15, 2023, by the Australian Government, IP Australia in corresponding Australian Patent Application No. 2020392420. (3 pages).

Notification Under Section 19 of Patents Act issued on Oct. 24, 2022, by the Finnish Patent Office in corresponding Finnish U.S. Appl. No. 20/196,035. (1 page).

Office Action (Communication of Acceptance) issued on Aug. 16, 2022, by the Finnish Patent Office in corresponding Finnish U.S. Appl. No. 20/196,035. (46 pages).

Office Action issued on Nov. 30, 2022, by the Brazilian Patent Office in corresponding Brazilian Patent Application No. BR112022010238-0, and an English Translation of the Office Action. (9 pages).

T. Kawanishi, "Upgrading of Light Thermal Cracking Oil Derived from Waste Plastics in Oil Refinery", Feedstock Recycling of Plastics, Pyrolysis/Solvolysis, 2005, pp. 43-50.

Hájeková et al., "Copyrolysis of naphtha with polyalkene cracking products; the influence of polyalkene mixtures composition on product distribution", J. Anal. Appl. Pyrolysis, 2007, vol. 79, pp. 196-204.

Hájeková et al., "Recycling of low-density polyethylene and polypropylene via copyrolysis of polyalkene oil/waxes with naphtha: product distribution and coke formation", J. Anal. Appl. Pyrolysis, 2005, vol. 74, pp. 270-281.

Hájeková et al., "Steam cracking of unconventional hydrocarbon feedstocks for production of petrochemicals"; 45th International Petroleum Conference, Jun. 13, 2011, Bratislava, Slovak Republic.

Matar et al., "Chemistry of Petrochemical Processes", Second Edition, Hydrocarbon Intermediates, 2004, pp. 43-44.

Opposition issued on Sep. 14, 2023, in corresponding Finnish Patent Application No. 129981. (20 pages).

Opposition issued Sep. 15, 2023, in corresponding Finnish Patent No. 129981. (28 pages).

Quatar Energyn markkinointimateriaali naftaan liittyen; haettu Sep. 13, 2023 internetsivulta: https://www.qatarenergy.qa/en/MarketingAndTrading/QPSPP/Pages/Naphthas.aspx.

Tukker et al., Chemical Recycling of Plastics Waste (PVC and other resins), TNO Institute of Strategy, Technology and Policy, Dec. 1999. (132 pages).

Williams et al., "Fluidised Bed Pyrolysis of Low Density Polyethylene to Produce Petrochemical Feedstock", Journal of Analytical and Applied Pyrolysis, 1999, vol. 51, pp. 107-126.

WIPO Document Made Available Under the Patent Cooperation Treaty (PCT). (31 pages) 2020.

Hájeková et al., "Coke Formation During Copyrolysis of Polyalkenes with Naphtha", Petroleum & Coal, 2008, vol. 50, No. 1, pp. 52-55.

Office Action issued on Feb. 26, 2024, by the Chinese Patent Office in corresponding Chinese Patent Application No. 202080091314.0, and an English Translation of the Office Action. (18 pages).

Office Action (Written Opinion) issued on May 21, 2024, by the Singapore Patent Office in corresponding Singapore Patent Application No. 11202205526Q, and an English Translation of the Office Action. (8 pages).

Office Action issued on Oct. 25, 2024, by the Korean Patent Office in corresponding Korean Patent Application No. 10-2022-7018038, and an English Translation of the Office Action. (15 pages).

(56) References Cited

OTHER PUBLICATIONS

Albright et al., "Pyrolysis: Theory and Industrial Practice", Hydrocarbon Processing Press, Sep. 30, 1990, pp. 324-325, with a machine English translation. (9 pages).
Second Office Action issued on Aug. 29, 2024, by the Chinese Patent Office in corresponding Chinese Patent Application No. 202080091314.0, and a machine English Translation of the Office Action. (21 pages).
Office Action (Communication) issued on Apr. 12, 2023, by the European Patent Office in corresponding European Patent Application No. 20 817 232.0. (3 pages).
Office Action (Communication) issued on Dec. 15, 2023, by the European Patent Office in corresponding European Patent Application No. 20 817 232.0. (5 pages).
Office Action (Communication) issued on Jun. 12, 2025, by the European Patent Office in corresponding European Patent Application No. 20 817 232.0. (4 pages).
Office Action issued on Jan. 23, 2026, by the Mexican Patent Office in corresponding Mexican Patent Application No. MX/a/2022/006218, and a partial English Translation of the Office Action. (5 pages).
Office Action issued on Aug. 26, 2025, by the Korean Patent Office in corresponding Korean Patent Application No. 10-2022-7018038, and an English Translation of the Office Action. (8 pages).
Office Action issued on Apr. 7, 2026, by the Mexican Patent Office in corresponding Mexican Patent Application No. MX/a/2022/006218, and a machine English Translation of the Office Action. (10 pages).

* cited by examiner

METHOD FOR UPGRADING LIQUEFIED WASTE PLASTICS

TECHNICAL FIELD

The present invention relates to a method for producing high quality components from a waste plastics raw material, in particular from liquefied waste plastics. Specifically, the present invention relates to a method for producing raw materials for chemical industry from plastic waste using a highly paraffinic material as a co-feed in a steam cracking process.

BACKGROUND OF THE INVENTION

The purification of liquefied waste plastics (LWP) to yield more valuable (pure) substances and the conversion of liquefied waste plastics (LWP) into more valuable material, such as low molecular olefins which can be used as raw material (e.g. as monomers) in chemical industry, have been studied for several years.

LWP is typically produced by hydrothermal liquefaction (HTL) or pyrolysis of waste plastics. Depending source of the waste plastics, LWP has variable levels of impurities. Typical impurity components are chlorine, nitrogen, sulphur and oxygen of which corrosive chlorine is particularly problematic for refinery/petrochemical processes. These impurities are also common in post-consumer waste plastics (recycled consumer plastics) that has been identified as the most potential large scale source for plastics waste. Moreover, LWP produced by a pyrolysis process usually contains significant amounts of olefins and aromatics, which may lead to problems in some downstream processes, such as polymerisation (or coking) at elevated temperatures.

No matter whether the LWP is merely subjected to common refinery processing (e.g. including fractionation and optionally hydrotreatment) or is forwarded to a typical petrochemical conversion process (such as a cracking process), the LWP material needs to be meet the impurity levels for these processes so as to avoid deterioration of the facility, such as corrosion of reactors or catalyst poisoning.

In addition to refining, chemical recycling of LWP back to plastic (or to monomers) is highly interesting option. This option has caught significant interest in the petrochemical industry during the last year. The interest has been further boosted by new waste directive and the EU plastic strategy that both set ambitious targets for the recycling of waste plastics.

It can thus be expected that chemical recycling will be an important method to recycle waste plastics back to plastics and chemicals in future. Liquefying waste plastics and using it as feedstock for crackers (such as catalytic crackers, hydrocrackers or steam crackers) is also a promising method to recycle plastics because of the existing infrastructure. However, the potential of LWP as cracker feedstock depends on its quality and thus methods for purifying the LWP and/or modifying the cracking procedures have been proposed in order to handle the varying impurity contents of LWP.

WO 2018/10443 A1 discloses a steam cracking process comprising pre-treatment of a mainly paraffinic hydrocarbon feed, such as hydrowax, hydrotreated vacuum gas oil, pyrolysis oil from waste plastics, gasoil or slackwax. Pre-treatment is carried out using a solvent extraction so as to reduce fouling components, such as polycyclic aromatics and resins.

US 2016/0264874 A1 discloses a process for upgrading waste plastics, comprising a pyrolysis step, a hydroprocessing step, a polishing step and a stream cracking step in this order. The cracking step may be integrated in a conventional cracking procedure using the liquefied waste plastics as a co-feed to conventional feed such as with naphtha or diesel.

Kawanishi, T., Shiratori, N., Wakao, H., Sugiyama, E., Ibe, H., Shioya, M., & Abe, T., "*Upgrading of Light Thermal Cracking Oil Derived from Waste Plastics in Oil Refinery. Feedstock recycling of plastics*." Universitätsverlag Karlsruhe, Karlsruhe (2005), p. 43-50 discloses hydrotreating a blend of petroleum fractions and light thermal cracking oil from waste plastics to avoid fouling of a heat exchanger preceding the hydrotreater.

SUMMARY OF INVENTION

The above prior art approaches employ complicated purification procedures, of which extraction techniques may result in significant amounts of contaminated extraction material, or employ a mixture of fossil fractions and LWP in conventional petrochemical processes. There is still need for a more sustainable process allowing recycling large amounts of LWP while producing low amounts of waste products and not requiring complicated equipment.

The present invention was made in view of the above-mentioned problems and it is an object of the present invention to provide an improved process for upgrading LWP, in particular a more sustainable process allowing recycling large amounts of LWP while producing low amounts of waste products and not requiring complicated equipment.

This problem is solved by a method of claim 1 which comprises a step (A) of providing liquefied waste plastics (LWP) material, optionally a step (B) of pre-treating at least part of the liquefied waste plastics (LWP) material to produce a pre-treated liquefied waste plastics (LWP) material, a step (C) of blending the liquefied waste plastics (LWP) material or the pre-treated liquefied waste plastics (LWP) material or a combination of both with a highly paraffinic material to obtain a cracker feed such that the cracker feed meets the requirements for chlorine content and olefins content of the steam cracker, and a step (D) of steam cracking the cracker feed in a steam cracker to obtain a cracker product.

The method of the present invention makes use of the synergies obtained by employing a highly paraffinic as a co-feed when subjecting LWP material and/or pre-treated LWP material to steam cracking.

Specifically, the inventors of the present invention surprisingly found that LWP material and/or pre-treated LWP material can be diluted with a highly paraffinic feed so as to meet impurity requirements for steam cracker while at the same time the yield of highly valuable products (in particular propylene and ethylene) is increased.

In the present invention, steam cracking is employed because of its robustness regarding impurities, although steam crackers have typically strict specification for the chlorine content and the levels of several other impurities/components such as N, S, O, olefins and aromatics are controlled as well. The present inventors found that even LWP material which is pre-treated with conventional means may not always reach the required impurity restrictions and thus further purification would be required. Thus, blending of LWP material and/or pre-treated LWP material with other feedstocks is necessary. While the prior art employs usual petrochemical product streams as a co-feed, the present inventors found that a combination of highly paraffinic feed with liquefied waste plastics (LWP) material and/or pre-treated LWP material provides a feed composition which is superior over each single feed alone.

In other words, the present invention not only achieves a method for co-processing LWP in low amounts while expecting less favourable product distribution, but actually provides a process having improved product distribution than one would expect from the blending ratio.

In brief, the present invention relates to one or more of the following items:

1. A method for upgrading liquefied waste plastics, the method comprising:
   a step (A) of providing liquefied waste plastics (LWP) material,
   optionally a step (B) of pre-treating at least part of the liquefied waste plastics (LWP) material to produce a pre-treated liquefied waste plastics (LWP) material,
   a step (C) of blending the liquefied waste plastics (LWP) material or the pre-treated liquefied waste plastics (LWP) material or a combination thereof with a highly paraffinic material to obtain a cracker feed such that the cracker feed meets the requirements for chlorine content and olefins content of the steam cracker, and
   a step (D) of steam cracking the cracker feed in a steam cracker to obtain a cracker product.
2. The method according to item 1, wherein the cracker feed that meets the requirements for chlorine content and olefins content of the steam cracker has a chlorine content of 10 ppm by weight (wt.-ppm) or less.
3. The method according to item 1 or 2, wherein the cracker feed that meets the requirements for chlorine content and olefins content of the steam cracker has a chlorine content of 8 wt.-ppm or less, 6 wt.-ppm or less, 5 wt.-ppm or less, 4 wt.-ppm or less, or 3 wt.-ppm or less.
4. The method according to any one of the preceding items, wherein the highly paraffinic material contains at last 90 wt.-% of compounds having 5 or more carbon atoms.
5. The method according to any one of the preceding items, wherein the highly paraffinic material has an initial boiling point (IBP) in the range of from 20° C. to 200° C.
6. The method according to any one of the preceding items, wherein the cracker feed that meets the requirements for chlorine content and olefins content of the steam cracker has an olefins content of 18.0 wt.-% or less.
7. The method according to any one of the preceding items, wherein the cracker feed that meets the requirements for chlorine content and olefins content of the steam cracker has an olefins content of 16.0 wt.-% or less, 14.0 wt.-% or less, 12.0 wt.-% or less, 10.0 wt.-% or less, 8 wt.-% or less, 6 wt.-% or less, 5 wt.-% or less, 4 wt.-% or less, 3.5 wt.-% or less, 3.0 wt.-% or less, 2.5 wt.-% or less, or 2.0 wt.-% or less.
8. The method according to any one of the preceding items, wherein the method comprises the pre-treatment step (B).
9. The method according to any one of the preceding items, wherein the pre-treatment step (B) comprises at least one of solvent extraction (extraction medium is an organic solvent) and extraction with an aqueous medium (extraction medium is an aqueous medium).
10. The method according to item 9, wherein the mass ratio between the amount (Ex) of extraction medium employed in the pre-treatment step (B) and the amount (LW) of liquefied waste plastics material fed to the pre-treatment step (B), Ex:LW, is in the range of 1:10 to 9:1.
11. The method according to any one of the preceding items, wherein the pre-treatment step (B) comprises at least contacting the liquefied waste plastics material with an aqueous medium.
12. The method according to any one of items 9 to 11, wherein the aqueous medium is an alkaline aqueous medium.
13. The method according to any one of the preceding items, wherein the pre-treatment step (B) is carried out at a temperature of 150° C. or more.
14. The method according to any one of the preceding items, wherein the pre-treatment step (B) is carried out at a temperature of 200° C. or more, preferably 220° C. or more, 240° C. or more or 260° C. or more.
15. The method according to any one of the preceding items, wherein the pre-treatment step (B) is carried out at a temperature of 450° C. or less, preferably 400° C. or less, 350° C. or less, or 300° C. or less.
16. The method according to any one of the preceding items, wherein the pre-treatment step (B) is carried out at a temperature in the range of 200° C. to 350° C., preferably 240° C. to 320° C., or 260° C. to 300° C.
17. The method according to any one of the preceding items, wherein no hydrogen is added in the pre-treatment step (B) and/or no hydrotreating catalyst is present.
18. The method according to any one of the preceding items, wherein the ratio between the bromine number (BN2) of the pre-treated liquefied waste plastics (LWP) material and the bromine number (BN1) of the liquefied waste plastics (LWP) material, BN2/BN1 is 0.90 or more, preferably 0.95 or more.
19. The method according to any one of the preceding items, wherein the chlorine content of the liquefied waste plastics (LWP) material before pre-treatment step (B) is in the range of from 1 wt.-ppm to 4000 wt.-ppm.
20. The method according to any one of the preceding items, wherein the chlorine content of the liquefied waste plastics (LWP) material before pre-treatment step (B) is in the range of from 100 wt.-ppm to 4000 wt.-ppm.
21. The method according to any one of the preceding items, wherein the chlorine content of the liquefied waste plastics (LWP) material before pre-treatment step (B) is in the range of from 300 wt.-ppm to 4000 wt.-ppm.
22. The method according to any one of the preceding items, wherein the chlorine content of the pre-treated liquefied waste plastics (LWP) material is 400 wt.-ppm or less, preferably 300 wt.-ppm or less.
23. The method according to any one of the preceding items, wherein the chlorine content of the pre-treated liquefied waste plastics (LWP) material is 200 wt.-ppm or less, preferably 100 wt.-ppm or less, more preferably 50 wt.-ppm or less.
24. The method according to any one of the preceding items, wherein the chlorine content of the pre-treated liquefied waste plastics (LWP) material is at most 50 wt.-%, more preferably at most 40 wt.-%, at most 30 wt.-% or at most 20 wt.-% of the chlorine content of the liquefied waste plastics (LWP) material before pre-treatment.
25. The method according to any one of the preceding items, wherein the liquefied waste plastics (LWP)

material or the pre-treated liquefied waste plastics (LWP) material or the combination thereof employed in step (C) does not meet the requirements for chlorine content and olefins content of the steam cracker.

26. The method according to any one of the preceding items, wherein the chlorine content of the liquefied waste plastics (LWP) material or the pre-treated liquefied waste plastics (LWP) material or the combination thereof employed in step (C) is more than 10 wt.-ppm and/or the olefins content of the liquefied waste plastics (LWP) material or the pre-treated liquefied waste plastics (LWP) material or the combination thereof employed in step (C) is more than 18 wt.-%.

27. The method according to any one of the preceding items, wherein the liquefied waste plastics (LWP) material provided in step (A) is a fraction of liquefied waste plastics.

28. The method according to any one of the preceding items, wherein the liquefied waste plastics (LWP) material provided in step (A) has a 5% boiling point of 25° C. or more and a 95% boiling point of 550° C. or less, preferably a 5% boiling point of 30° C. or more and a 95% boiling point of 500° C. or less, more preferably a 5% boiling point of 35° C. or more and a 95% boiling point of 400° C. or less, even more preferably a 5% boiling point of 35° C. or more and a 95% boiling point of 360° C. or less.

29. The method according to any one of the preceding items, wherein the highly paraffinic material is at least one of a naphtha fraction, a middle distillate fraction, a VGO fraction or a LPG fraction, or a mixture of two or more thereof, preferably at least one of a naphtha fraction and a middle distillate fraction.

30. The method according to any one of the preceding items, wherein the highly paraffinic material has a paraffin content of 60 wt.-% or more, relative to the total weight of the highly paraffinic material.

31. The method according to any one of the preceding items, wherein the highly paraffinic material has a paraffin content of 65 wt.-% or more, preferably 70 wt.-% or more, 75 wt.-% or more, 80 wt.-% or more, 85 wt.-% or more, or 90 wt.-% or more, relative to the total weight of the highly paraffinic material.

32. The method according to any one of the preceding items, wherein the highly paraffinic material has a paraffin content of 93 wt.-% or more, or 95 wt.-% or more, relative to the total weight of the highly paraffinic material.

33. The method according to any one of the preceding items, wherein the highly paraffinic material has an i-paraffin content of 5 wt.-% or more, relative to the summed amount of n-paraffins and i-paraffins in the highly paraffinic material taken as 100 wt.-%.

34. The method according to any one of the preceding items, wherein the highly paraffinic material has an i-paraffin content of 8 wt.-% or more, preferably 10 wt.-% or more, 15 wt.-% or more, 20 wt.-% or more, 25 wt.-% or more, 30 wt.-% or more, 35 wt.-% or more, 40 wt.-% or more, 45 wt.-% or more, 50 wt.-% or more, relative to the summed amount of n-paraffins and i-paraffins in the highly paraffinic material taken as 100 wt.-%.

35. The method according to any one of the preceding items, wherein the highly paraffinic material has an i-paraffin content in the range from 45 wt.-% to 70 wt.-%, preferably 50 wt.-% to 65 wt.-%, relative to the summed amount of n-paraffins and i-paraffins in the highly paraffinic material taken as 100 wt.-%.

36. The method according to any one of the preceding items, wherein the highly paraffinic material has a n-paraffin content in the range from 50 wt.-% to 25 wt.-%, preferably 45 wt.-% to 30 wt.-%, relative to the summed amount of n-paraffins and i-paraffins in the highly paraffinic material taken as 100 wt.-%.

37. The method according to any one of the preceding items, wherein the highly paraffinic material has a naphthenes content in the range from 0.01 wt.-% to 15.00 wt.-%, preferably 0.01 wt.-% to 5.00 wt.-%, relative to the total weight of the highly paraffinic material.

38. The method according to any one of items 1 to 34, wherein the highly paraffinic material an i-paraffin content in the range from 50 wt.-% to 100 wt.-%, preferably 65 wt.-% to 100 wt.-%, 75 wt.-% to 100 wt.-%, or 85 wt.-% to 100 wt.-%, relative to the summed amount of n-paraffins and i-paraffins in the highly paraffinic material taken as 100 wt.-%.

39. The method according to any one of items 1 to 34, wherein the highly paraffinic material has a paraffin content of 93 wt.-% or more, relative to the total weight of the highly paraffinic material, and an i-paraffin content in the range from 65 wt.-% to 100 wt.-%, 75 wt.-% to 100 wt.-%, preferably 85 wt.-% to 100 wt.-%, relative to the summed amount of n-paraffins and i-paraffins in the highly paraffinic material taken as 100 wt.-%.

40. The method according to any one of the preceding items, wherein the highly paraffinic material is a renewable material.

41. The method according to any one of the preceding items, wherein the blending ratio between the total amount of liquefied waste plastics (LWP) material and pre-treated liquefied waste plastics (LWP) material employed in step (C) and the highly paraffinic material in step (C) (LWPt:highly paraffinic material) is 0.5:99.5 to 90:10 parts by weight when the summed amount of LWPt and highly paraffinic material (LWPt+highly paraffinic material) is taken as 100 parts by weight.

42. The method according to item 41, wherein the blending ratio is in the range of from 1:99 to 80:20 parts by weight, preferably 5:95 to 75:25 parts by weight.

43. The method according to any of the items 1 to 42, wherein the step (A) of providing liquefied waste plastics (LWP) material includes a step of liquefying waste plastics, preferably by thermal degradation of waste plastics, such as pyrolysis or hydrothermal liquefaction or similar process steps.

44. The method according to any of the items 1 to 43, wherein the step (A) of providing liquefied waste plastics (LWP) material includes a step of sorting waste plastics to provide sorted waste plastics, wherein the sorting preferably removes at least 50 wt.-%, more preferably at least 55 wt.-%, at least 60 wt.-%, at least 65 wt.-%, at least 70 wt.-%, at least 75 wt.-%, at least 80 wt.-%, or at least 85 wt.-% of chlorine-containing waste plastics, such as polyvinyl chloride, PVC, (relative to the original content of chlorine-containing waste plastic in the waste plastics).

45. The method according to item 44, further comprising a step of liquefying the sorted waste plastics to provide liquefied sorted waste plastics (LSWP) material.

46. The method according to any of the items 1 to 45, wherein the step (B) comprises pre-treating at least (non-sorted) LWP material.
47. The method according to any of the items 1 to 46, wherein the step (C) employs liquefied sorted waste plastics (LSWP) material as the LWP material and/or pre-treated (preferably non-sorted) LWP material as the pre-treated LWP material, wherein the liquefied sorted waste plastics (LSWP) material is a material obtainable by liquefying (and optionally fractionating) sorted waste plastics.
48. The method according to item 47, wherein the amount of chlorine-containing waste plastics in the sorted waste plastics is 5 wt.-% or less, preferably 3 wt.-% or less, 2 wt.-% or less, or 1 wt.-% or less.
49. The method according to item 47 or 48, wherein the amount of PVC in the sorted waste plastics is 5 wt.-% or less, preferably 3 wt.-% or less, 2 wt.-% or less, or 1 wt.-% or less.
50. A mixture of hydrocarbons obtainable by the method according to any of the items 1 to 49.
51. Use of the mixture of hydrocarbons according to item 50 for producing chemicals and/or polymers, such as polypropylene and/or polyethylene.

DETAILED DESCRIPTION OF THE INVENTION

Figure 1:
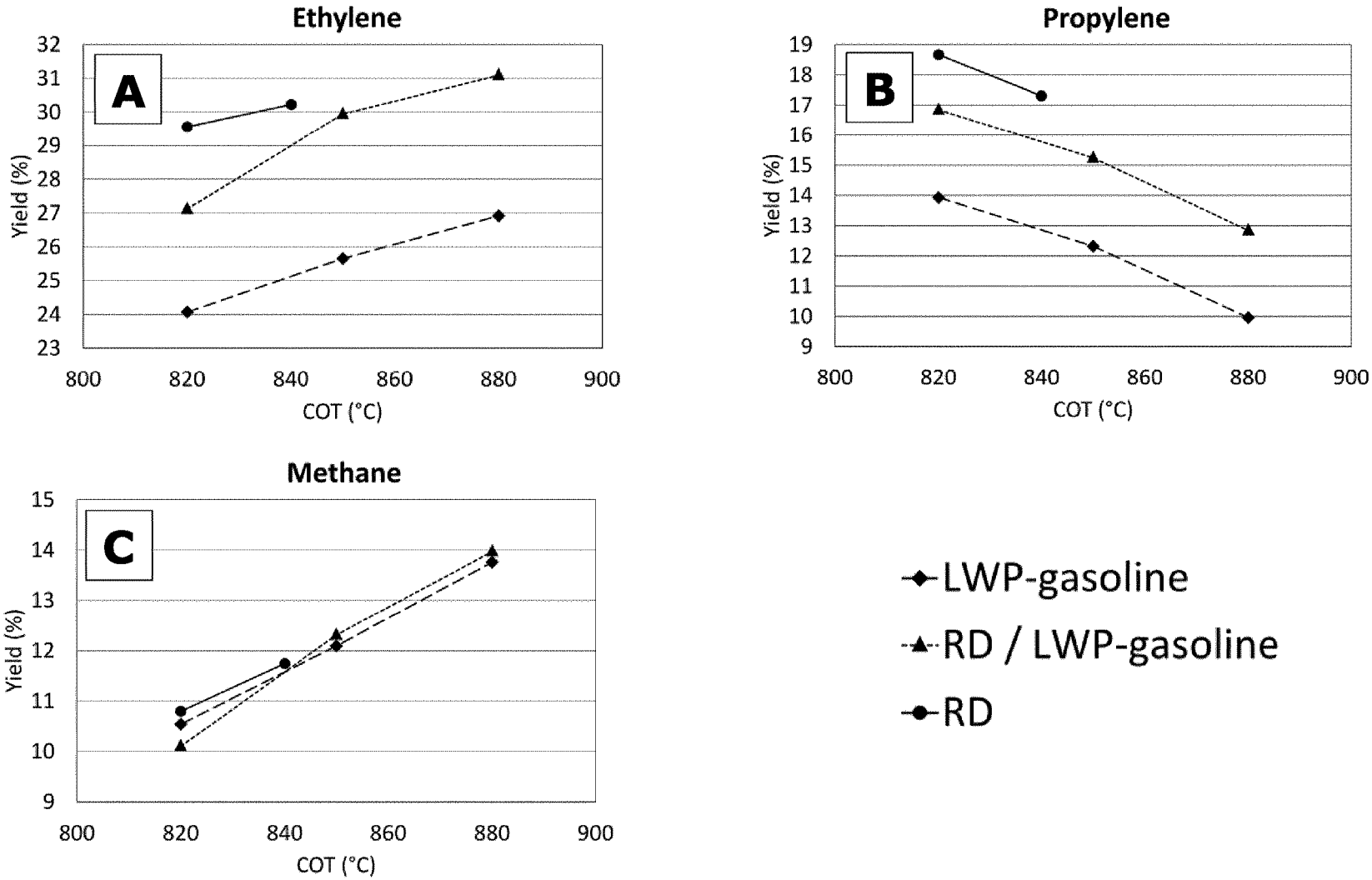
FIG. 1 is a graph comparing ethylene (1A), propylene (1B) and methane (1C) yields obtained in the steam cracking experiments of Examples 1, 2 and 3

The present invention relates to a method for upgrading liquefied plastics. The method comprises a step (A) of providing liquefied waste plastics (LWP) material. The mode of providing the liquefied waste plastics material is not particularly limited. That is, the liquefied waste plastics material may be produced as a part of the process of the present invention or may be purchased or procured in any other way.

The method of the present invention further optionally comprises a step (B) of pre-treating at least part of the liquefied waste plastics (LWP) material to produce a pre-treated liquefied waste plastics (LWP) material. That is, step (B) is optional while steps (A), (C) and (D) are mandatory. A pre-treatment step (B) may be particularly suitable in case the LWP material has a high degree of contamination. In this case, the pre-treatment step is for reducing the amount (content) of at least one of the contaminants in the LWP material. In particular, it is preferred that the content of at least one of Cl, N and S contaminants is reduced, more preferably at least the content of Cl contaminants.

The contaminants may be present in the LWP material in any form, e.g. in elemental form (dissolved or dispersed) or usually as organic or inorganic (usually organic) compounds.

The method of the present invention comprises a step (C) of blending the liquefied waste plastics (LWP) material or the pre-treated liquefied waste plastics (LWP) material or the combination thereof employed in step (C) with a highly paraffinic material to obtain a cracker feed. In other words, the step (C) may employ either the pre-treated LWP material or LWP material which is not pre-treated in step (B) (i.e. the step (B) is omitted). The step (C) may also employ a mixture of pre-treated LWP material and non-pre-treated LWP material.

When employing a mixture (a combination of LWP material and pre-treated LWP material), it is preferable that at least 10 wt.-% of the liquefied waste plastic provided in step (A) is pre-treated in step (B), preferably at least 25 wt.-%, at least 50 wt.-%, at least 75 wt.-% or at least 90 wt.-% of the liquefied waste plastic is pre-treated.

Furthermore, the step (C) may employ (non-pre-treated) liquefied sorted waste plastics (LSWP) material, which is a material obtained by liquefying (and optionally purification, for example by fractionating) sorted waste plastics. The sorted waste plastics are materials having a decreased content of chlorine-containing plastics as compared to unsorted waste plastics. The content (amount) of chlorine-containing waste plastics in the sorted waste plastics is preferably 5 wt.-% or less, more preferably 3 wt.-% or less, 2 wt.-% or less, or 1 wt.-% or less. The amount of PVC in the sorted waste plastics is preferably 5 wt.-% or less, more preferably 3 wt.-% or less, 2 wt.-% or less, or 1 wt.-% or less. In this respect, the amount (or content) of chlorine-containing waste plastics (or PVC) relates to the amount (mass) of plastic pieces (physically isolated parts) containing chlorine (or PVC).

The blending step (C) comprises blending liquefied waste plastics (LWP) material or the pre-treated liquefied waste plastics (LWP) material or the combination thereof employed in step (C) with a highly paraffinic material and optionally with an additional blending material. The additional blending material may be employed in an amount of at most 50 wt.-% (relative to the resulting blend, i.e. relative to the cracker feed, as a whole), preferably 40 wt.-% or less, 30 wt.-% or less, 20 wt.-% or less, 10 wt.-% or less or 5 wt.-% or less. The additional blending material needs not be added and thus may be omitted. The additional blending material may be any commonly used cracker feed material, such as a fossil material. The additional blending material preferably has an olefins content of 10 wt.-% or less (more preferably 5 wt.-% or less, 3 wt.-% or less, or 2 wt.-% or less).

The blending step (C) is carried out in such a manner that the cracker feed meets the requirements for chlorine content and olefins content of the steam cracker. In other words, the step (C) comprises adding the highly paraffinic material in such an amount that the blend (i.e. the cracker feed) meets these requirements. Preferably, the blend is intimately mixed before being fed to the steam cracker, using a batch-wise mixer or mixing means in a continuous process or both.

Preferably, the step (C) comprises a sub-step (C1) of determining at least one of the chlorine concentration and the olefins concentration of the liquefied waste plastics (LWP) material or the pre-treated liquefied waste plastics (LWP) material or the combination thereof employed in step (C), a sub-step (C2) of determining (calculating) the amount of the highly paraffinic material which needs to be added so as to meet the requirements for chlorine content and olefins content of the steam cracker, and a sub-step (C3) of adding at least the determined (calculated) amount of the highly paraffinic material.

The sub-steps C1, C2 and C3 may be carried out continuously or batch-wise. One or two of sub-steps C1, C2 and C3 may be carried out continuously and the other one or the other two may be carried out batch-wise. It is preferred that the mode of operation (continuously or batch-wise) is the same for sub-steps C1 and C2. In case of a continuous addition, the sub-steps (C2) and (C3) preferably provide the "amount" of the highly paraffinic material as a flow rate relative to the flow rate of the (optionally at least partly pre-treated) LWP material (total flow rate of pre-treated LWP material and non-pre-treated LWP material).

The method of the invention further comprises a step (D) of steam cracking the cracker feed in a steam cracker to obtain a cracker product. It is important to employ steam cracking in the present invention (as opposed to e.g. hydrocracking or catalytic cracking) since the product distribution of the cracker product is most favourable when employing the blend of (optionally at least partly pre-treated) LWP material and highly paraffinic feed in combination with steam cracking.

LWP material, such as a pyrolysis product of collected consumer plastics, contains large and varying amounts of contaminants which would be detrimental in steam cracking or in downstream processes. Such contaminants include, among others, halogens (mainly chlorine) originating from halogenated plastics (such as PVC and PTFE), sulfur originating from cross-linking agents of rubbery polymers (e.g. in end-of-life tires) and metal (e.g. Si, Al) contaminants originating from composite materials and additives (e.g. films coated with metals or metal compounds, end-of-life tires, or plastics processing aids). These contaminants may be present in elemental form, in ionic form, or as a part of organic or inorganic compounds.

These impurities/contaminants may result in coking in conventional steam cracking methods and may similarly result in (undesired) side-reactions, thus shifting the product distribution to less valuable products or even towards products which have to be disposed (i.e. waste). Similarly, these impurities may have corrosive or otherwise degrading action, thus reducing the service life of the steam cracking apparatus. In this respect, chlorine (and chlorine compounds) is one impurity which has high tendency to cause corrosion in a steam cracking apparatus.

Moreover, the production process of LWP material usually comprises at least one kind of thermal degradation, such as pyrolysis or hydrothermal liquefaction or similar process steps. It is intrinsic to these processes that the resulting LWP has a high olefins content.

In the present invention, the content of olefins (n-olefins, iso-olefins, diolefins, higher olefins and olefinic naphthenes), paraffins (n-paraffins and/or i-paraffins), naphthenes (excluding olefinic naphthenes) and aromatics may be determined by gas chromatography (GC) combined with a flame ionisation detector (FID) using the PIONA method (GC-FID). PIONA method is suitable for gasoline range products i.e. products boiling in the range of about 25-180° C. The content (paraffins, iso-paraffins, olefins, naphthenes, aromatics) of higher-boiling hydrocarbons, i.e. products in the range of about 180-440° C. can be determined by comprehensive gas chromatography combined with FID detector (GC×GC-FID). In case of broad boiling ranges, both methods may be used in combination.

In the present invention, the content of iso-paraffins is determined relative to the amount of total paraffins. The content of F, Cl, and Br may be determined in accordance with ASTM-D7359-18. The content of iodine (I) and sulphur (S) may be determined by XFS (X-ray fluorescence spectroscopy). Nitrogen (N) content may be determined in accordance with ASTM-D5762. Contents of phosphorous, sulphur and oxygen may be determined using known methods, e.g. P (ASTM D5185), S (ASTM D6667M) and O (ASTM D7423). The content of metal atoms may be determined using inductively coupled plasma atomic emission spectrometry (ICP-AES) based on standard ASTM D5185. The content of silicon (Si) may be determined using X-ray fluorescence (XRF) spectroscopy or using ICP-AES based on ASTM D5185. Contents of carbon (C), hydrogen (H) and others may be determined by elemental analysis using e.g. ASTM D5291.

In the present invention, the cracker feed that meets the requirements for chlorine content and olefins content of the steam cracker preferably has a chlorine content of 10 ppm by weight (wt.-ppm) or less. Chlorine impurities are very harmful for the steam cracker equipment and thus should be rigorously controlled. More preferably, the cracker feed that meets the requirements for chlorine content and olefins content of the steam cracker has a chlorine content of 8 wt.-ppm or less, 6 wt.-ppm or less, 5 wt.-ppm or less, 4 wt.-ppm or less, or 3 wt.-ppm or less.

If not mentioned otherwise, a content of a feed component and/or impurity is given relative to the feed as a whole being 100%.

Preferably, the highly paraffinic material contains at least 90 wt.-% of compounds having 5 or more carbon atoms (C5-plus material). In other words, it is preferred that at least 90 wt.-% of the highly paraffinic material is made up of compounds having 5 or more carbon atoms. In particular, the highly paraffinic material should not have too much C4-minus material (compounds having 4 or less carbon atoms), since these components are volatile and thus handling is difficult, especially in the blending step. Moreover, C5-plus material has more pronounced effects on the product distribution. It is particular preferable that the highly paraffinic material contains at least 90 wt.-% of compounds having a carbon number (number of carbon atoms) in the range of from 5 to 40.

The highly paraffinic material preferably has a 5% boiling point (based on ASTM D86) in the range of from 20° C. to 300° C. In other words, the highly paraffinic material may have a boiling start point (5% boiling point) which is comparable to that of usual (e.g. fossil) fuel fractions.

The cracker feed that meets the requirements for chlorine content and olefins content of the steam cracker preferably has an olefins content of 18.0 wt.-% or less. Olefins tend to cause coking or fouling in the steam cracker and thus their content should be controlled to a relatively low level. Thus, more preferably, the cracker feed that meets the requirements for chlorine content and olefins content of the steam cracker has an olefins content of 16 wt.-% or less, 14 wt.-% or less, 12 wt.-% or less, 10 wt.-% or less, 8 wt.-% or less, 6 wt.-% or less, 5 wt.-% or less, 4 wt.-% or less, 3.5 wt.-% or less, 3.0 wt.-% or less, 2.5 wt.-% or less, or 2.0 wt.-% or less.

In order to meet the steam cracker requirements while not requiring too much addition of highly paraffinic co-feed, in the method preferably comprises the pre-treatment step (B) as a process step. A pre-treatment step (B) within the meaning of the present invention is not a mere separation or fractionation step. In other words, although the pre-treatment step (B) may comprise separation step(s) (such as filtration, centrifugation, sedimentation and the like) and evaporation step(s) (such as evaporation, distillation, fractionation and the like), the pre-treatment step (B) does not consist of one or more of these steps.

In the present invention, the pre-treatment step (B) preferably comprises at least one of non-reactive extraction (such as solvent extraction) and reactive extraction (in which the LWP material is chemically modified in the course of the extraction step). Preferably, the non-reactive extraction and/or the reactive extraction are liquid-liquid extractions.

In particular, the pre-treatment step (B) preferably comprises contacting (e.g. blending) the liquefied waste plastics material (or at least part thereof) with at least a liquid extraction medium, e.g. an organic solvent in the case of solvent extraction or a reactive extraction medium (such as alkaline aqueous solution), and optionally with further material(s), followed by liquid-liquid separation, if necessary, between the liquefied waste plastics material and the extraction medium, and then removal of the extraction medium (comprising impurities) to obtain a pre-treated (purified) waste plastics material. Phase separation (in the course of liquid-liquid separation) may be induced phase separation, e.g. using physical methods (such as centrifugation) or chemical methods (such as addition of separation aids, e.g. solvent(s) other than the extraction medium or additional amounts of the extraction medium used before), or non-induced phase separation, such as gravity-driven phase separation.

When employing solvent extraction, the solvent is a polar organic solvent. The organic solvent may be a protic or an aprotic solvent, preferably an aprotic solvent.

Preferably, the mass ratio between the amount (Ex) of extraction medium employed in the pre-treatment step (B) and the amount (LW) of liquefied waste plastics material fed to the pre-treatment step (B), Ex:LW, is in the range of 1:10 to 9:1. This means that the content of Ex relative to Ex+LW is about 9.09 to 90 wt.-%. Hence, good impurity removal efficiency can be achieved. The ratio is preferably 1:5 to 5:1, more preferably 1:5 to 2:1, or 1:5 to 1.5:1.

The pre-treatment step (B) preferably comprises at least a sub-step of contacting (at least part of) the liquefied waste plastics material with an aqueous medium.

In the context of the present invention, the term "contacting" comprises physical contact and may be carried out batch-wise, e.g. using blending or mixing, or continuously, e.g. using co-current or counter-current flow, or using a combination of both. Due to easier handling, co-current flow is preferred.

The aqueous medium comprises at least 50 wt.-% water, preferably at least 70 wt.-% water, more preferably at least 85 wt.-% water or at least 90 wt.-% water, and may comprise further ingredients which are admixed with or dissolved in the water.

Preferably, the aqueous medium is an alkaline aqueous medium. The present inventors found that by contacting a contaminated material with an alkaline aqueous medium, the aqueous medium can act as a reactive extraction medium, thus converting contaminants (including organic compounds) into water-soluble contaminants (and other products which may be water-soluble or water-insoluble) and these can thus be extracted together with the water.

The alkaline aqueous medium comprises water and an alkaline substance (basic substance) which is dissolved in water. The alkaline substance preferably is or comprises a metal hydroxide, more preferably a hydroxide of an alkali metal and/or a hydroxide of an alkaline earth metal. Preferably, the alkaline substance comprises at least an alkali metal ion, more preferably at least one of $Na^+$ and $K^+$. The pH of the alkaline aqueous medium is more than 7, preferably 8 or more and more preferably 9 or more. The alkaline aqueous medium preferably comprises at least 0.3 wt.-% of a metal hydroxide, more preferably at least 0.5 wt.-%, at least 1.0 wt.-% or at least 1.5 wt.-%. It is particularly preferred that the alkaline aqueous medium comprises at least 0.5 wt.-%, preferably at least 1.0 wt.-% or at least 1.5 wt.-% of an alkali metal hydroxide.

The pre-treatment step (B) is preferably carried out at a temperature of 150° C. or more, especially when employing reactive extraction (i.e. in this case the reactive extraction is carried out at the specified temperature while other or additional pre-treatment steps may be carried out at different temperature), e.g. when the pre-treatment is carried out using an alkaline aqueous solution. The elevated temperature promotes the reactions of a reactive extraction and therefore results in faster and more efficient pre-treatment. The pre-treatment step (B) may be carried out at elevated pressure so as to ensure that the material in the pre-treatment reactor remains liquid. Useful (absolute) pressure is 1 bar or more, 10 bar or more, 40 bar or more, or 60 bar or more. In order to keep equipment costs within reasonable limits the pressure should not exceed 400 bar and is preferably 200 bar or less, 150 bar or less or 100 bar or less. The pre-treatment reactor may be a continuous flow reactor or a batch reactor or both and may be the same reactor as one of the reactors employed in other steps of the process, but it is preferably a different reactor or a different section of the same reactor.

When employing elevated temperature, the pre-treatment step (B) may be carried out at a temperature of 200° C. or more, preferably 220° C. or more, 240° C. or more or 260° C. or more. Usually, the upper limit of the pre-treatment temperature is 600° C. so as to avoid excessive degradation. However, it is preferred that the pre-treatment step (B) is carried out at a temperature of 450° C. or less, preferably 400° C. or less, 350° C. or less, or 300° C. or less.

In particular, the pre-treatment step (B) may be carried out at a temperature in the range of 200° C. to 350° C., preferably 240° C. to 320° C., or 260° C. to 300° C.

In the present invention, it is preferred that no hydrogen is added in the pre-treatment step (B) and/or no hydrotreating catalyst is present. That is, the pre-treatment step preferably does not comprise or essentially consist of a hydrotreatment process in which the impurities are removed by hydrotreatment e.g. as HCl in the case of chlorine, or resulting in saturation of olefins. Preferably, at least one of hydrogen and hydrotreatment catalyst is absent in the pre-treatment step (at least at the same time), more preferably both are absent.

That is, although hydrotreatment, in particular hydrogenation, can be favourable, such a procedure is less sustainable because of significant hydrogen gas consumption which is usually produced from fossil sources and/or with significant amounts of energy.

More preferably, no hydrogen gas (including dissolved hydrogen gas) is present during the pre-treatment step (B).

In the present invention, it is preferable that the ratio between the bromine number (BN2) of the pre-treated liquefied waste plastics (LWP) material and the bromine number (BN1) of the liquefied waste plastics (LWP) material (the part which is employed in the pre-treatment), BN2/BN1 is 0.90 or more, preferably 0.95 or more. In the present invention, the bromine number can be determined in accordance with ASTM D1159-07 (2017).

The bromine number (BN2) of the pre-treated liquefied waste plastics (LWP) material refers to the bromine number immediately after the pre-treatment step (B). The bromine number (BN1) of the liquefied waste plastics (LWP) material refers to the bromine number immediately before the pre-treatment step (B). In other words, in this embodiment, the pre-treatment does not significantly reduce the amount of olefins. This similarly means that the pre-treatment step substantially does not result in saturation of olefins. That is, although olefins can be harmful for the steam cracker, the present invention employs the highly paraffinic feed and thus can meet the olefins restrictions without the need to employ a saturation treatment (e.g. hydrogenation). Usually the olefins content will not increase by the pre-treatment (except for minor effects due to removal of impurity components) and thus the upper limit of the ratio may be 1.2 and is preferably 1.1 or 1.0.

The chlorine content of the liquefied waste plastics (LWP) material (the part which is employed in the pre-treatment) before pre-treatment step (B) is preferably in the range of from 1 wt.-ppm to 4000 wt.-ppm. That is, the method of the present invention is suited to process LWP material having a broad concentration range of chlorine impurities.

Preferably, the chlorine content of the liquefied waste plastics (LWP) material (the part which is employed in the pre-treatment) before pre-treatment step (B) is in the range of from 100 wt.-ppm to 4000 wt.-ppm. In other words, the present invention is particularly suitable for materials having a chlorine content which is significantly higher than tolerated by a steam cracker. The chlorine content of the liquefied waste plastics (LWP) material before pre-treatment step (B) may be in the range of from 200 wt.-ppm to 4000 wt.-ppm, or in the range of from 300 wt.-ppm to 4000 wt.-ppm.

Preferably, the chlorine content of the pre-treated liquefied waste plastics (LWP) material is 400 wt.-ppm or less, preferably 300 wt.-ppm or less, 200 wt.-ppm or less, 100 wt.-ppm or less, or more preferably 50 wt.-ppm or less. It is furthermore preferred that the chlorine content of the pre-treated liquefied waste plastics (LWP) material at most 50 wt.-% of the chlorine content of the liquefied waste plastics (LWP) material before pre-treatment (i.e. by means of the pre-treatment, the chlorine content is reduced by at least 50 wt.-%, more preferably at least 60 wt.-% even more preferably at least 70 wt.-% or at least 80 wt.-%).

On the other hand, since high purification degrees require significant efforts, it is nevertheless preferred that the liquefied waste plastics (LWP) material or the pre-treated liquefied waste plastics (LWP) material or the combination thereof (sometimes also referred to as "optionally at least partly pre-treated LWP material") employed in step (C) does not meet the requirements for chlorine content and olefins content of the steam cracker.

Preferably, the chlorine content of the liquefied waste plastics (LWP) material or the pre-treated liquefied waste plastics (LWP) material or the combination thereof employed in step (C) is more than 4 wt.-ppm and/or the olefins content of the liquefied waste plastics (LWP) material or the pre-treated liquefied waste plastics (LWP) material or the combination thereof employed in step (C) is more than 10 wt.-%. Further preferably, the chlorine content of the liquefied waste plastics (LWP) material or the pre-treated liquefied waste plastics (LWP) material or the combination thereof employed in step (C) is more than 6 wt.-ppm, more than 8 wt.-ppm or more than 10 wt.-ppm. Further, the chlorine content of the liquefied waste plastics (LWP) material or the pre-treated liquefied waste plastics (LWP) material or the combination thereof employed in step (C) may be more than 14 wt.-%, or more than 18 wt.-%.

The liquefied waste plastics (LWP) material provided in step (A) may be a fraction of liquefied waste plastics. The step (A) may comprise a sub-step (A2) of fractionating liquefied waste plastics, but the fraction of liquefied waste plastics may similarly be purchased or provided by other means.

The step (A) may further comprise a sub-step (A1) of liquefying waste plastics, either alone or together with sub-step (A2). The liquefying may be carried out by any known method such as pyrolysis, including fast pyrolysis, hydropyrolysis and hydrothermal liquefaction.

The liquefied waste plastics (LWP) material provided in step (A) preferably has a 5% boiling point of 25° C. or more and a 95% boiling point of 550° C. or less. The 5% and 95% boiling points of the LWP material may be determined in accordance with ASTM D2887-16.

The highly paraffinic material is preferably at least one of a naphtha fraction, a middle distillate fraction, a VGO fraction or a LPG fraction, or a mixture of two or more thereof, preferably at least one of a naphtha fraction and a middle distillate fraction.

Preferably only one of these fractions is employed as a highly paraffinic material. In the context of the present invention, a naphtha fraction preferably has a boiling start point of 25° C. or more and a boiling end point of 200° C. or less (ASTM D86); a middle distillate fraction preferably has a boiling start point of 180° C. or more and a boiling end point of 360° C. or less (ASTM D86); a VGO fraction preferably has a boiling start point of 360° C. or more (ASTM D2887-16); and a LPG fraction preferably has a boiling end point of 25° C. or less (ASTM D86).

In the present invention, it is preferred that the highly paraffinic material has a paraffin content of 60 wt.-% or more, since the beneficial effects of the present invention will thus be more pronounced. In the context of the present invention, the paraffins content refers to the sum of contents of n-paraffins and i-paraffins and is determined relative to the highly paraffinic material as a whole. More preferably, the highly paraffinic material has a paraffin content of 65 wt.-% or more, 70 wt.-% or more, 75 wt.-% or more, 80 wt.-% or more, 85 wt.-% or more, 90 wt.-% or more, 93 wt.-% or more, or 95 wt.-% or more.

Even better results can be achieved when employing a highly paraffinic material containing i-paraffins (iso-paraffins). It is preferred that the highly paraffinic material has an i-paraffin content of 5 wt.-% or more. In the present invention, the i-paraffin content is determined relative to total paraffins content of the highly paraffinic material taken as 100 wt.-%. More preferably, the highly paraffinic material has an i-paraffin content of 8 wt.-% or more, 10 wt.-% or more, preferably 15 wt.-% or more, 20 wt.-% or more, 25 wt.-% or more, 30 wt.-% or more, 35 wt.-% or more, 40 wt.-% or more, 45 wt.-% or more, 50 wt.-% or more.

In an embodiment, the highly paraffinic material has an i-paraffin content in the range from 45 wt.-% to 70 wt.-%, preferably 50 wt.-% to 65 wt.-%.

In another embodiment, the highly paraffinic material has a paraffin content of 95 wt.-% or more and an i-paraffin content in the range from 80 wt.-% to 100 wt.-%, preferably 85 wt.-% to 99 wt.-%.

The highly paraffinic material preferably has a n-paraffin content in the range from 50 wt.-% to 25 wt.-%, preferably 45 wt.-% to 30 wt.-%. In the present invention, the n-paraffin content is determined relative to total paraffins content of the highly paraffinic material taken as 100 wt.-%. The highly paraffinic material preferably has a naphthenes content in the range from 0.01 wt.-% to 15.00 wt.-%, preferably 0.01 wt.-% to 5.00 wt.-%. The naphthenes content is determined relative to the highly paraffinic material as a whole.

In view of sustainability, it is particularly preferable that the highly paraffinic material be a renewable material.

Renewable in the context of the present invention means a renewable content (content of bio-material; more specifically carbon derived from bio-material, i.e. bio-carbon) of 95 wt.-% or more. The content of bio-carbon (bio-material) may be determined in accordance with ASTM D 6866-18.

In particular, a renewable material obtained by hydrotreating (hydrodeoxygenation) of triglycerides and/or fatty acids and optionally isomerisation, followed by fractionation so as to obtain a renewable material fraction is preferred in the present invention. Such a material can provide a well-defined and quite uniform carbon number distribution which has been found to further improve the product distribution of the method of the present invention.

Especially renewable diesel (diesel fraction obtained by hydrotreating triglycerides, followed by isomerisation and fractionation) is a highly potential blending component for LWP for several reasons. First, LWP and renewable diesel are complementary because both feedstocks can fulfil several sustainability targets. Second, renewable diesel is an excellent blending feedstock having very low impurity, olefin or aromatic levels. Therefore, renewable diesel can be used to reduce the impurity levels and boost the performance of LWP and thus make it more suitable feedstock, especially for naphtha crackers.

The steam cracking process of the present invention may be carried out under usual conditions known in the art. Since the core of the present invention is the steam cracker feed material, the steam cracking process as such is not described in full detail and the reader may refer to the prior art for suitable variations.

In general, the steam cracking step is performed at elevated temperatures, preferably in the range of from 650 to 1000° C., more preferably of from 750 to 850° C. Steam is mixed with the hydrocarbon feed before the cracking zone, making the cracking reaction more robust against impurities and coke precursors. The cracking usually occurs in the absence of oxygen. The residence time at the cracking conditions is very short, typically in the order of milliseconds. From the cracker, a cracker effluent is obtained that may comprise aromatics, olefins, hydrogen, water, carbon dioxide and other hydrocarbon compounds. The specific products obtained depend on the composition of the feed, the hydrocarbon-to-steam ratio, and the cracking temperature and furnace residence time. The cracked products (also referred to as "cracker products" or "cracking products") from the steam cracker are then usually passed through one or more heat exchangers, often referred to as TLE's, to rapidly reduce the temperature of the cracked products. The TLE's preferably cool the cracked products to a temperature in the range of from 400 to 550° C.

In the present invention, the term "cracking products" (or "cracked products" or "cracker products") may refer to products obtained directly after the steam cracking step (also referred to as "thermal cracking step" in the following), or to derivatives thereof, i.e. "cracking products" as used herein refers to the hydrocarbon species in the mixture of hydrocarbons, and their derivatives.

"Obtained directly after the steam cracking step" may be interpreted as including optional separation and/or purification steps. As used herein, the term "cracking product" may also refer to the mixture of hydrocarbons obtained directly after the steam cracking step as such.

The present invention provides a mixture of hydrocarbons obtainable by the method according to the invention. The mixture of hydrocarbons corresponds to the mixture which is directly obtained after thermal cracking without further purification.

The present invention further provides use of the mixture of hydrocarbons for producing chemicals and/or polymers. Use of the mixture of hydrocarbons for producing chemicals and/or polymers may comprise a separation step to separate at least one hydrocarbon compound from the mixture of hydrocarbons.

The cracking products described herein are examples of cracking products obtainable with the present invention. The cracking products of a certain embodiment may include one or more of the cracking products described in the following.

In a preferred embodiment, the cracking products include one or more of hydrogen, methane, ethane, ethene, propane, propene, propadiene, butane and butylenes, such as butene, iso-butene, and butadiene, C5+ hydrocarbons, such as aromatics, benzene, toluene, xylenes, and C5-C18 paraffins or olefins, and their derivatives.

Such derivatives are, for example, methane derivatives, ethene derivatives, propene derivatives, benzene derivatives, toluene derivatives, and xylene derivatives, and their derivatives.

Methane derivatives include, for example, ammonia, methanol, phosgene, hydrogen, oxochemicals and their derivatives, such as methanol derivatives. Methanol derivatives include, for example, methyl methacrylate, polymethyl methacrylate, formaldehyde, phenolic resins, polyurethanes, methyl-tert-butyl ether, and their derivatives.

Ethene derivatives include, for example, ethylene oxide, ethylene dichloride, acetaldehyde, ethylbenzene, alpha-olefins, and polyethylene, and their derivatives, such as ethylene oxide derivatives, ethylbenzene derivatives, and acetaldehyde derivatives. Ethylene oxide derivatives include, for example, ethylene glycols, ethylene glycol ethers, ethylene glycol ethers acetates, polyesters, ethanol amines, ethyl carbonates and their derivatives. Ethylbenzene derivatives include, for example, styrene, acrylonitrile butadiene styrene, styrene-acrylonitrile resin, polystyrene, unsaturated polyesters, and styrene-butadiene rubber, and their derivatives. Acetaldehyde derivatives include, for example, acetic acid, vinyl acetate monomer, polyvinyl acetate polymers, and their derivatives. Ethyl alcohol derivatives include, for example, ethyl amines, ethyl acetate, ethyl acrylate, acrylate elastomers, synthetic rubber, and their derivatives. Further, ethene derivatives include polymers, such as polyvinyl chloride, polyvinyl alcohol, polyester such as polyethylene terephthalate, polyvinyl chloride, polystyrene, and their derivatives.

Propene derivatives include, for example, isopropanol, acrylonitrile, polypropylene, propylene oxide, acrylic acid, allyl chloride, oxoalcohols, cumens, acetone, acrolein, hydroquinone, isopropylphenols, 4-hethylpentene-1, alkylates, butyraldehyde, ethylene-propylene elastomers, and their derivatives. Propylene oxide derivatives include, for example, propylene carbonates, allyl alcohols, isopropanolamines, propylene glycols, glycol ethers, polyether polyols, polyoxypropyleneamines, 1,4-butanediol, and their derivatives. Allyl chloride derivatives include, for example, epichlorohydrin and epoxy resins. Isopropanol derivatives include, for example, acetone, isopropyl acetate, isophorone, methyl methacrylate, polymethyl methacrylate, and their derivatives. Butyraldehyde derivatives include, for example, acrylic acid, acrylic acid esters, isobutanol, isobutylacetate, n-butanol, n-butylacetate, ethylhexanol, and their derivatives. Acrylic acid derivatives include, for example, acrylate esters, polyacrylates and water absorbing polymers, such as super absorbents, and their derivatives.

Butylene derivatives include, for example, alkylates, methyl tert-butyl ether, ethyl tert-butyl ether, polyethylene copolymer, polybutenes, valeraldehyde, 1,2-butylene oxide, propylene, octenes, sec-butyl alcohol, butylene rubber, methyl methacrylate, isobutylenes, polyisobutylenes, substituted phenols, such as p-tert-butylphenol, di-tert-butyl-p-cresol and 2,6-di-tert-butylphenol, polyols, and their derivatives. Other butadiene derivatives may be styrene butylene rubber, polybutadiene, nitrile, polychloroprene, adiponitrile, acrylonitrile butadiene styrene, styrene-butadiene copolymer latexes, styrene block copolymers, styrene-butadiene rubber.

Benzene derivatives include, for example, ethyl benzene, styrene, cumene, phenol, cyclohexane, nitrobenzene, alkylbenzene, maleic anhydride, chlorobenzene, benzene sulphonic acid, biphenyl, hydroquinone, resorcinol, polystyrene, styrene-acrylonitrile resin, styrene-butadiene rubber, acrylonitrile-butadiene-styrene resin, styrene block copolymers, bisphenol A, polycarbonate, methyl diphenyl diisocyanate and their derivatives. Cyclohexane derivatives include, for example, adipic acid, caprolactam and their derivatives. Nitrobenzene derivatives include, for example, aniline, methylene diphenyl diisocyanate, polyisocyanates and polyurethanes. Alkylbenzene derivatives include, for example, linear alkybenzene. Chlorobenzene derivatives include, for example, polysulfone, polyphenylene sulfide, and nitrobenzene. Phenol derivatives include, for example, bisphenol A, phenol form aldehyde resins, cyclohexanone-cyclohexenol mixture (KA-oil), caprolactam, polyamides, alkylphenols, such as p-nonoylphenol and p-dedocylphenol, ortho-xylenol, aryl phosphates, o-cresol, and cyclohexanol.

Toluene derivatives include, for example, benzene, xylenes, toluene diisocyanate, benzoic acid, and their derivatives.

Xylene derivatives include, for example, aromatic diacids and anhydrates, such as terephthalic acid, isophthalic acid, and phthalic anhydrate, and phthalic acid, and their derivatives. Derivatives of terephthalic acid include, for example, terephthalic acid esters, such as dimethyl terephthalate, and polyesters, such as polyethylene terephthalate, polytrimethylene terephthalate, polybutylene terephthalate and polyester polyols. Phthalic acid derivatives include, for example, unsaturated polyesters, and PVC plasticizers. Isophthalic acid derivatives include, for example, unsaturated polyesters, polyethylene terephthalate co-polymers, and polyester polyols.

The hydrocarbons obtained or obtainable with the method according to the present invention are particularly suitable as raw materials for conventional petrochemistry, and polymer industry. Specifically, the mixture of hydrocarbons obtained from the present invention show a product distribution which is similar to, and even favourable over, the product distribution obtained from thermal (steam) cracking of conventional raw material, i.e. neat fossil raw material.

Thus, these hydrocarbons can be added to the known value-added chain while no significant modifications of production processes are required.

The cracking products of the current invention may be used in a wide variety of applications. Such applications are, for example, consumer electronics, composites, automotive, packaging, medical equipment, agrochemicals, coolants, footwear, paper, coatings, adhesives, inks, pharmaceuticals, electric and electronic appliances, sport equipment, disposables, paints, textiles, super absorbents, building and construction, fuels, detergents, furniture, sportswear, solvents, plasticizers and surfactants.

EXAMPLES

Steam cracking was carried out under varying coil outlet temperature (COT) conditions using LWP fractions, a renewable hydrocarbon fraction, fossil naphtha and blends of LWP fractions with renewable hydrocarbon or fossil naphtha. Water to hydrocarbon ratio (gH2O/HC) was 0.5 in all experiments. The water to hydrocarbon ration was adjusted by feeding the water fraction at the rate of 0.075 kg/h and the hydrocarbon fraction at the rate of 0.15 kg/h. The coil outlet pressure (COP) was 1.7 bar(a) in all experiments. Sulphur content (related to the HC content) was adjusted by dimethyl disulfide (DMDS) to 250 ppm in all experiments.

Description of the Analytic Methods

The compositions of the renewable hydrocarbon compositions and the composition of LWP diesel were analysed by comprehensive gas chromatography (GC×GC-FID). Samples of the renewable hydrocarbon and LWP diesel compositions were analysed as such, without any pretreatment. 3-chlorothiophene was added into the sample as an internal standard. The method is suitable for hydrocarbons C6-C28. N-paraffins and other compounds/compound groups were identified using comprehensive gas chromatography mass spectrometry (GC×GC-MS) and a mixture of known n-paraffins in the range of C6-C28. The 2D chromatograms were divided into groups of paraffins (=isoparaffins & n-paraffin by carbon number), naphthenes and aromatics by using Zoex GC Image software. Compound groups were quantified by using internal standard calibration (n-decane and/or n-pentadecane representing paraffins, hexyl-cyclohexane and/or decalin representing naphthenes and toluene and/or 1,2,4,5-tetramethylbenzene representing aromatics). The limit of quantitation for individual compounds was 0.1 wt-%. N-paraffin results were determined using the GC-FID method. Settings of the GC×GC are shown in Table 1.

TABLE 1

Settings of GC × GC determination of n- and i-paraffins, naphthenes and aromatics.

| | GC |
|---|---|
| Injection | split/splitless-injector<br>Split 350:1 (injection volume 0.2 μL) |
| Column 1 | Rxi ™-17SilMS (length 30 m, inner diameter, i.d., 0.25 mm, phase thickness 0.25 μm) |
| Column 2 | Rxi ™-5SilMS (length 1.8 m, i.d. 0.18 mm, phase thickness 0.18 μm) |
| Carrier gas | He |
| Detector | FID (flame ionization detector) |
| GC program | 40° C. (0 min) - 5° C./min - 250° C. (0 min) - 10° C./min - 300° C. (5 min), constant flow 1.6 mL/min |
| Modulation | Zoex Thermal Modulation (liquid $N_2$ cooling), modulation 10 s |

The i-paraffins and n-paraffins content of the renewable hydrocarbon compositions were analysed by gas chromatography (GC). Samples of the renewable isomeric paraffin composition were diluted into dichloromethane (1:10 v/v) before analysis. The method is suitable for hydrocarbons C6-C36. N-paraffins were identified using mass spectrometry and a mixture of known n-paraffins in the range of C6-C36. The chromatograms were split into groups of paraffins (isoparaffins/n-paraffin) by integrating the groups into the chromatogram baseline right before and after n-paraffin peak. Solvent peak is excluded. Compounds or compound groups were quantified by normalization using relative response factor of 1.0 to all hydrocarbons. The limit of quantitation for individual compounds was 0.01 wt-%. Settings of the GC are shown in Table 2.

TABLE 2

Settings of GC determination of n- and i-paraffins.

| | GC |
|---|---|
| Injection | split/splitless-injector<br>Split 80:1 (injection volume 1.0 μL) |
| Column | DB ™-5 (length 30 m, i.d. 0.25 mm, phase thickness 0.25 μm) |
| Carrier gas | He |
| Detector | FID (flame ionization detector) |
| GC program | 30° C. (2 min) - 5° C./min - 300° C. (30 min), constant flow 1.1 mL/min |

PiONA (paraffins, isoparaffins, olefins, naphthenes, aromatics) composition of the LWP gasoline used in the examples and in the comparative examples was determined by gas chromatography coupled to a flame ionization detector (GC-FID).

Example 1 (Reference)

A renewable hydrocarbon fraction (sample "RD") having a 5%-95% boiling point range of 245-295° C. (ASTM D 86), a paraffin content of 99 wt.-% and an i-paraffin content (relative to total paraffins) of 93 wt.-% was subjected to steam cracking at temperatures (coil outlet temperature; COT) of 820° C. and 840° C. The yields of ethylene, propylene and methane were analysed by GC-FID and the results are shown in FIG. 1A to 1C.

Example 2 (Reference)

A gasoline fraction of a LWP material ("LWP-gasoline") was pre-treated and then subjected to steam cracking.

The LWP gasoline had a chlorine content of 590 wt.-ppm and an olefin content of 61 wt.-% (including n-olefins, iso-olefins, diolefins and olefinic naphthenes) and a 5%-95% boiling range of 85-174° C. Further impurities are N (500 wt.-ppm), Br (210 wt.-ppm) and S (89 wt.-ppm).

Pre-treatment was carried out in a stirred batch reactor using 300 parts LWP gasoline and 200 parts 2 wt. % aqueous NaOH. The reactor was sealed at ambient pressure and temperature and then heated up to 240° C., holding this temperature for 30 minutes and then allowing the reactor to cool down again. The water phase was roughly decanted from the organic phase, followed by centrifugation (20° C., 4300 rpm, 30 minutes) of the organic phase and recovering the separated organic phase.

The pre-treated material showed significantly decreased impurity levels for N (25 wt.-ppm; 95% decrease), Cl (36 wt.-ppm; 94% decrease), Br (7 wt.-ppm; 97% decrease) and S (80 wt.-ppm; 10% decrease), while the olefins content was found to be slightly increased (66 wt.-% after pre-treatment).

Although the pre-treated LWP gasoline did not fully meet the steam cracker requirements regarding the Cl content and the olefins content, it was subjected to steam cracking under the same conditions as in Example 1 (only using 850° C. instead of 840° C.) and the product was analysed.

The results are shown in FIG. 1A to 1C, showing that the yield of both ethylene and propylene was significantly lower than in the case of the RD sample.

Example 3

25 wt.-parts of the pre-treated LWP-gasoline of Example 2 were blended with 75 wt.-parts of the RD sample of Example 1, thus forming a blend fulfilling the steam cracker requirements for chlorine content (9 wt.-ppm in the blend) and olefins content (16.5 wt.-% in the blend).

The blend was subjected to steam cracking under the same conditions as in Example 2 and the product was analysed.

The results are shown in FIG. 1A to 1C, showing that the blend shows almost no drop of ethylene and propylene yield at the industrially important COT of 850° C., thus providing a significant improvement over what would be expected from the blending ratio. Accordingly, the addition of the highly paraffinic material provides a significant improvement although the olefins content of the blend is at the upper limit that is tolerated by the steam cracker.

Example 4

1 wt.-part of the non-pre-treated LWP-gasoline of Example 2 was blended with 99 wt.-parts of the RD sample of Example 1, thus forming a blend fulfilling the steam cracker requirements for chlorine content (5.9 wt.-ppm in the blend) and olefins content (0.66 wt.-% in the blend).

The blend was subjected to steam cracking under the same conditions as in Example 3 and the product was analysed.

The results (not shown) indicate that the product distribution of the blend is virtually the same as that of the RD sample alone.

Example 5 (Reference)

A diesel fraction of a LWP material (LWP diesel) was pre-treated and then subjected to steam cracking.

The LWP diesel had a chlorine content of 590 wt.-ppm and an olefin content of 58 wt.-% (including n-olefins, iso-olefins, diolefins and olefinic naphthenes) and a 5%-95% boiling range of 172-342° C. Further impurities are N (810 wt.-ppm), Br (325 wt.-ppm) and S (695 wt.-ppm).

Pre-treatment was carried out by solvent extraction with a mixed solvent of 98 wt.-% NMP (N-methyl-2-pyrrolidone) and 2 wt.-% water using a glass separation funnel at ambient temperature (21° C.) at a mixing ratio of 3:1 (solvent:LWP diesel). After separation, the NMP phase was removed and solvent extraction was repeated two more times under the same conditions, followed by washing the LWP diesel with water (2 parts water, 1 part LWP diesel) and separation of water.

The pre-treated material showed decreased impurity levels for N (24 wt.-ppm; 97% decrease), Cl (40 wt.-ppm; 93% decrease), Br (14 wt.-ppm; 96% decrease) and S (35 wt.-ppm; 95% decrease), while the olefins content remained substantially the same (63 wt.-%).

Although the pre-treated LWP diesel did not fully meet the steam cracker requirements regarding the Cl content and olefins content, it was subjected to steam cracking under the same conditions as in Example 1 (only using 850° C. instead of 840° C.) and the product was analysed.

Figure 2:
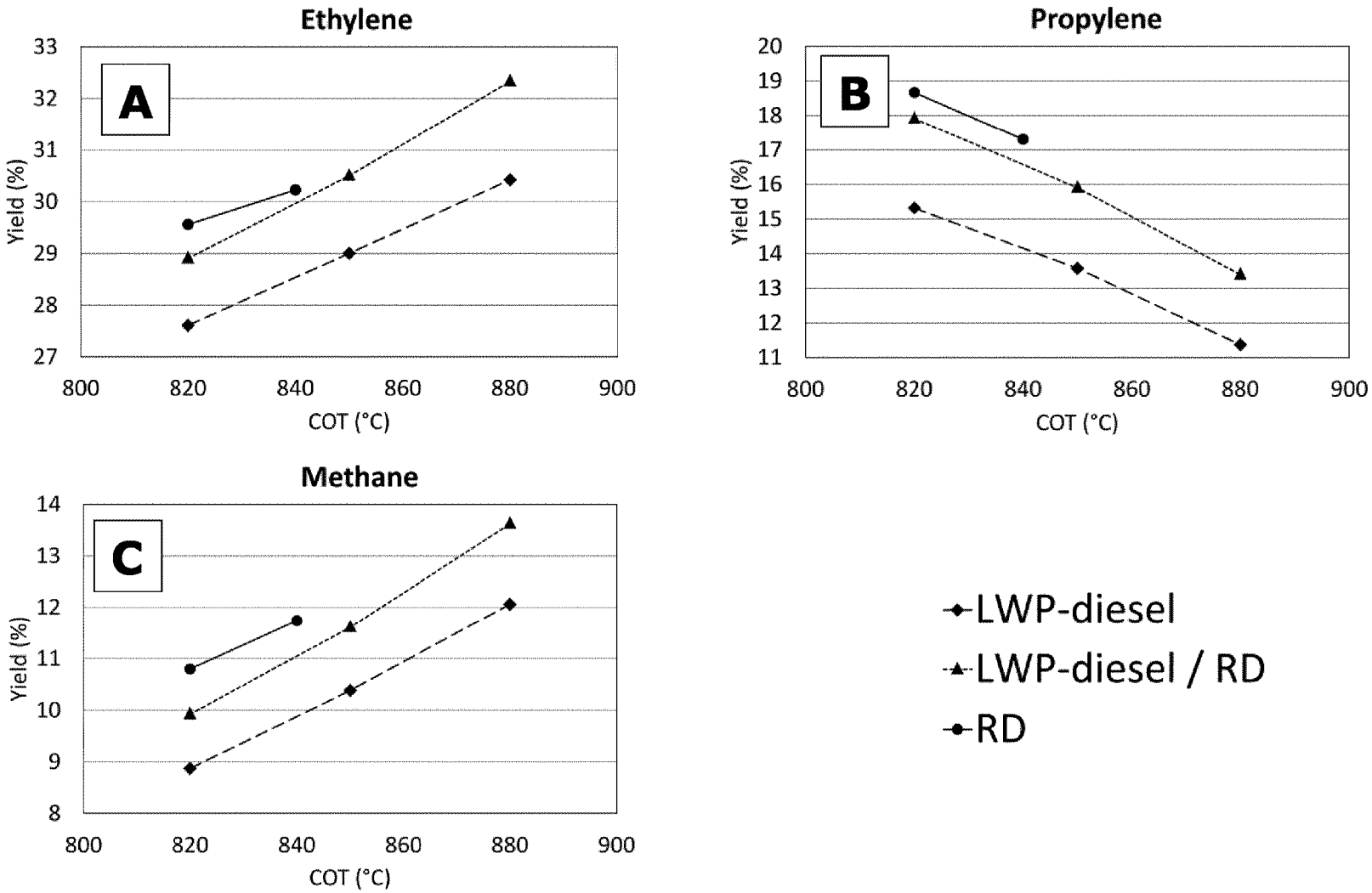
FIG. 2 is a graph comparing ethylene (2A), propylene (2B) and methane (2C) yields obtained in the steam cracking experiments of Examples 1, 5 and 6

The results are shown in FIG. 2A to 2C.

Example 6

25 wt.-parts of the pre-treated LWP diesel of Example 5 were blended with 75 wt.-parts "RD" of Example 1, thus forming a blend fulfilling the steam cracker requirements for chlorine content (10 wt.-ppm in the blend) and olefins content (about 16 wt.-% in the blend).

The blend was subjected to steam cracking under the same conditions as in Example 5 and the product was analysed.

The results are shown in FIG. 2A to 2C. Results of Example 1 (RD only) are included in FIG. 2A to 2C for reference as well. The results indicate that the blend provides roughly the same (in part even improved) ethylene and propylene yield as the RD sample.

The invention claimed is:

1. A method for upgrading liquefied waste plastics, the method comprising:

providing a liquefied waste plastics (LWP) material having a chlorine content ranging from 100 ppm by weight (wt.-ppm) to 4000 wt.-ppm and a 5% boiling point of 25° C. or more and a 95% boiling point of 360° C. or less;

optionally pre-treating at least part of the LWP material to produce a pre-treated LWP material, wherein no hydrogen is added during the pre-treating;

blending the LWP material, the pre-treated LWP material or a combination thereof with a paraffinic material feed stream containing a paraffin content of 60 wt.-% or more, relative to a total weight of the paraffinic material feed stream, to obtain a cracker feed that meets requirements for chlorine content and olefins content of a steam cracker; and steam cracking the cracker feed in the steam cracker to obtain a cracker product.

2. The method according to claim 1, wherein the cracker feed has a chlorine content of 10 ppm wt.-ppm or less.

3. The method according to claim 1, wherein the paraffinic material feed stream contains at least 90 wt.-% of compounds having 5 or more carbon atoms.

4. The method according to claim 1, wherein the cracker feed has an olefins content of 18.0 wt.-% or less.

5. The method according to claim 1, wherein the optional pre-treating comprises:

at least one of organic solvent extraction and an extraction with an aqueous medium.

6. The method according to claim 1, wherein the optional pre-treating comprises:

at least contacting the LWP material with an aqueous medium, wherein the aqueous medium is an alkaline aqueous medium.

7. The method according to claim 1, wherein the optional pre-treating is carried out at a temperature ranging from 150° C. to 450° C.

8. The method according to claim 1, wherein the provided LWP material is a fraction of liquefied waste plastics.

9. The method according to claim 1, wherein the paraffinic material feed stream is at least one of a naphtha fraction, a middle distillate fraction, a VGO fraction or a LPG fraction.

10. The method according to claim 1, wherein the paraffinic material feed stream has a paraffin content of either 65 wt.-% or more, 70 wt.-% or more, 75 wt.-% or more, 80 wt.-% or more, 85 wt.-% or more, 90 wt.-% or more, 93 wt.-% or more, or 95 wt.-% or more, relative to the total weight of the paraffinic material feed stream.

11. The method according to claim 1, wherein the paraffinic material feed stream has an i-paraffin content of 5 wt.-% or more, 8 wt.-% or more, 10 wt.-% or more, 15 wt.-% or more, 20 wt.-% or more, 25 wt.-% or more, 30 wt.-% or more, 35 wt.-% or more, 40 wt.-% or more, 45 wt.-% or more, or 50 wt.-% or more, relative to a summed amount of n-paraffins and i-paraffins in the paraffinic material feed stream taken as 100 wt.-%.

12. The method according to claim 1, wherein the paraffinic material feed stream has a n-paraffin content in a range from 25 wt.-% to 50 wt.-%, or 30 wt.-% to 45 wt.-%, relative to a summed amount of n-paraffins and i-paraffins in the paraffinic material feed stream taken as 100 wt.-%.

13. The method according to claim 1, wherein the paraffinic material feed stream has a naphthenes content in a range from 0.01 wt.-% to 5.00 wt.-%, relative to the total weight of the paraffinic material feed stream.

14. The method according to claim 1, wherein the paraffinic material feed stream comprises a renewable material.

15. The method of claim 1, wherein the LWP material has a chlorine content ranging from 200 ppm by weight (wt.-ppm) to 4000 wt.-ppm.

16. The method of claim 1, wherein the LWP material, the pre-treated LWP material or the combination thereof does not meet the requirements for chlorine content and/or olefins content of the steam cracker before blending with the paraffinic material feed stream.

17. The method of claim 1, wherein the paraffinic material feed stream has a naphthenes content in a range from 0.01 wt.-% to 15.00 wt.-%.

18. The method of claim 1, wherein the paraffinic material feed stream contains at least 90 wt.-% of compounds having 5 or more carbon atoms.

19. A method for upgrading liquefied waste plastics, the method comprising:

providing a liquefied waste plastics (LWP) material having a chlorine content ranging from 100 ppm by weight (wt.-ppm) to 4000 wt.-ppm and a first bromine number of the LWP material (BN1);

pre-treating at least part of the LWP material to produce a pre-treated LWP material, wherein the pre-treated LWP material has a second bromine number (BN2) that, when divided by BN1, results in a BN2/BN1 ratio of 0.90 or more, and wherein no hydrogen is added during the pre-treating;

blending the LWP material, the pre-treated LWP material or a combination thereof with a paraffinic material feed stream containing a paraffin content of 60 wt.-% or more, relative to a total weight of the paraffinic material feed stream, to obtain a cracker feed that meets requirements for chlorine content and olefins content of a steam cracker, wherein the paraffinic material feed stream contains at least 90 wt.-% of compounds having 5 or more carbon atoms; and steam cracking the cracker feed in the steam cracker to obtain a cracker product.

* * * * *